United States Patent [19]

Persson

[11] Patent Number: 4,634,188

[45] Date of Patent: Jan. 6, 1987

[54] ROTARY TOOL

[75] Inventor: Gert Persson, Lyckeby, Sweden

[73] Assignee: Dynapac AB, Solna, Sweden

[21] Appl. No.: 724,007

[22] Filed: Apr. 17, 1985

[30] Foreign Application Priority Data

Apr. 18, 1984 [DE] Fed. Rep. of Germany ... 8412179[U]

[51] Int. Cl.[4] ..... E01C 23/08

[52] U.S. Cl. ..... 299/39; 299/40; 299/41; 125/5

[58] Field of Search ..... 299/39, 40, 41, 55, 299/90, 78, 88, 89; 404/90, 91; 125/3.5; 51/176

[56] References Cited

U.S. PATENT DOCUMENTS

| | | | |
|---|---|---|---|
| 1,836,638 | 12/1931 | Wright et al. | 175/350 |
| 3,179,103 | 4/1965 | Doran | 125/3 |
| 3,260,254 | 7/1966 | Collins | 125/5 |
| 3,263,666 | 8/1966 | Collins | 125/5 |
| 3,422,579 | 1/1969 | Rogge et al. | 51/176 |
| 3,430,718 | 3/1969 | Lawrence | 175/350 |
| 3,550,575 | 12/1970 | Metzger | 125/3 |
| 3,825,361 | 7/1974 | Steiner | 299/41 X |
| 4,188,696 | 2/1980 | Collins et al. | 125/5 |
| 4,275,928 | 6/1981 | Jackson | 299/86 |

FOREIGN PATENT DOCUMENTS

| | | | |
|---|---|---|---|
| 87952 | 11/1895 | Fed. Rep. of Germany | 175/350 |
| 2417752 | 7/1975 | Fed. Rep. of Germany | 404/90 |
| 845659 | 8/1960 | United Kingdom | 299/41 |

*Primary Examiner*—James A. Leppink
*Assistant Examiner*—Michael A. Goodwin
*Attorney, Agent, or Firm*—Walter Ottesen

[57] ABSTRACT

The invention is directed to a rotary tool for attachment to a machine for working and smoothing an even surface of a base made of cement, concrete or similar hard material. The machine includes a multi-wheeled vehicle and at least one tool drive shaft arranged on the vehicle. The tool drive shaft defines a longitudinal axis extending perpendicularly to the base to be worked and has a tool holder for holding the rotary tool. The rotary tool includes a plate on which a plurality of cutter-wheel units are mounted about the periphery thereof. Each of the cutter-wheel units includes a frame attached to the plate and axles mounted so as to define respective rotational axes parallel to the plate and substantially parallel to a radius passing through the longitudinal axis of the tool drive shaft. A plurality of cutter wheels is mounted on the axles so as to rotate freely with respect thereto.

10 Claims, 8 Drawing Figures

ROTARY TOOL

FIELD OF THE INVENTION

The invention relates to a rotary tool such as a cutter head or milling head for a machine for working and smoothing an even surface of a base made of cement, concrete or similar hard material. The machine includes a multi-wheeled vehicle and at least one vertical tool drive shaft equipped with a tool holder for holding the rotary tool.

BACKGROUND OF THE INVENTION

Machines of the kind referred to above include a vehicle with three or more wheels and one or more rotary tools which are arranged on respective vertically driven drive shafts. The rotary tools rest on the base during the time that the surface thereof is worked. The wheels of the vehicle which can, for example, be three in number are on the surface to be worked during the working procedure and carry the weight of the vehicle. One of the wheels is used to steer the machine with a vertical control shaft. The vehicle carries a motor to drive the cutter head and a control apparatus.

The rotary tool is held by a tool holder which in turn is attached to a vertically positioned rotatable shaft mounted in a bearing housing. The bearing housing is mounted on the vehicle chassis so that it is freely movable with respect to the vehicle in the vertical direction. The pressure of the cutter head on the surface to be worked is adjustable by means of a displacement mechanism or separate loading weights. The weight of the vehicle chassis is carried by the wheels which is in contrast to other known machines wherein the weight is carried by the cutter heads. This weight is so selected that the wheels press against the base with such a load that a displacement of the machine as a consequence of the rotation of the rotary tool is prevented. More specifically, the friction forces between the wheels and the base exceed the action of the torque that is developed by the rotary tool so that the torque developed by the rotary tool is taken up by the machine and not by the operator of the machine.

SUMMARY OF THE INVENTION

It is an object of the invention to provide a rotary tool for a machine of the kind described above which is in the form of a cutter head or milling head and which can be produced simply and economically as well as being durable in operation and reliable.

The rotary tool of the invention attaches to a machine for working and smoothing an even surface of a base made of cement, concrete or similar hard material. The machine includes a multi-wheeled vehicle and at least one tool drive shaft arranged on the vehicle. The tool drive shaft defines a longitudinal axis extending perpendicularly to the base to be worked and has a tool holder for holding the rotary tool. The rotary tool of the invention includes: a tool plate; attachment means for mounting the plate to the tool holder in a position perpendicular to the longitudinal axis; a plurality of cutter-wheel units distributed about the periphery of the plate; each of the cutter-wheel units including frame means attached to the plate; axle means mounted in the frame means so as to define a rotational axis parallel to the plate and substantially parallel to a radius passing through the longitudinal axis defined by the tool drive shaft; and, a plurality of cutter wheels mounted on the axle means so as to rotate freely with respect thereto about the rotational axis.

In the operation of a tool of this kind, the tool plate rotates with the rotation of the tool drive shaft and the cutter wheels which bear on the base are rotated at high velocity. The cutter wheels bear against the base with individual points and are made of hardened material in correspondence to their function or, are provided with especially hard metal caps or inserts so that an intense abrasive action is achieved as the rotary tool rotates and as the machine is moved simultaneously relative to the base.

According to a preferred embodiment of the invention, the axles on which the cutter wheels freely rotate are parallelly displaced from the radii of the rotary tool so that a smoothing movement of the points of the cutter wheels over the base is achieved when the rotary tool is rotated even when the machine is at standstill.

An especially advantageous embodiment is achieved by providing three cutter-wheel units spaced evenly, one from the other, and mounted on the tool plate. Each cutter unit includes two rows of cutter wheels displaced with respect to each other. The cutter wheels are arranged symmetrically to the radius of the tool plate.

BRIEF DESCRIPTION OF THE DRAWING

The invention will now be described with reference to the drawing wherein.

DESCRIPTION OF THE PREFERRED EMBODIMENTS OF THE INVENTION

Figure 1:
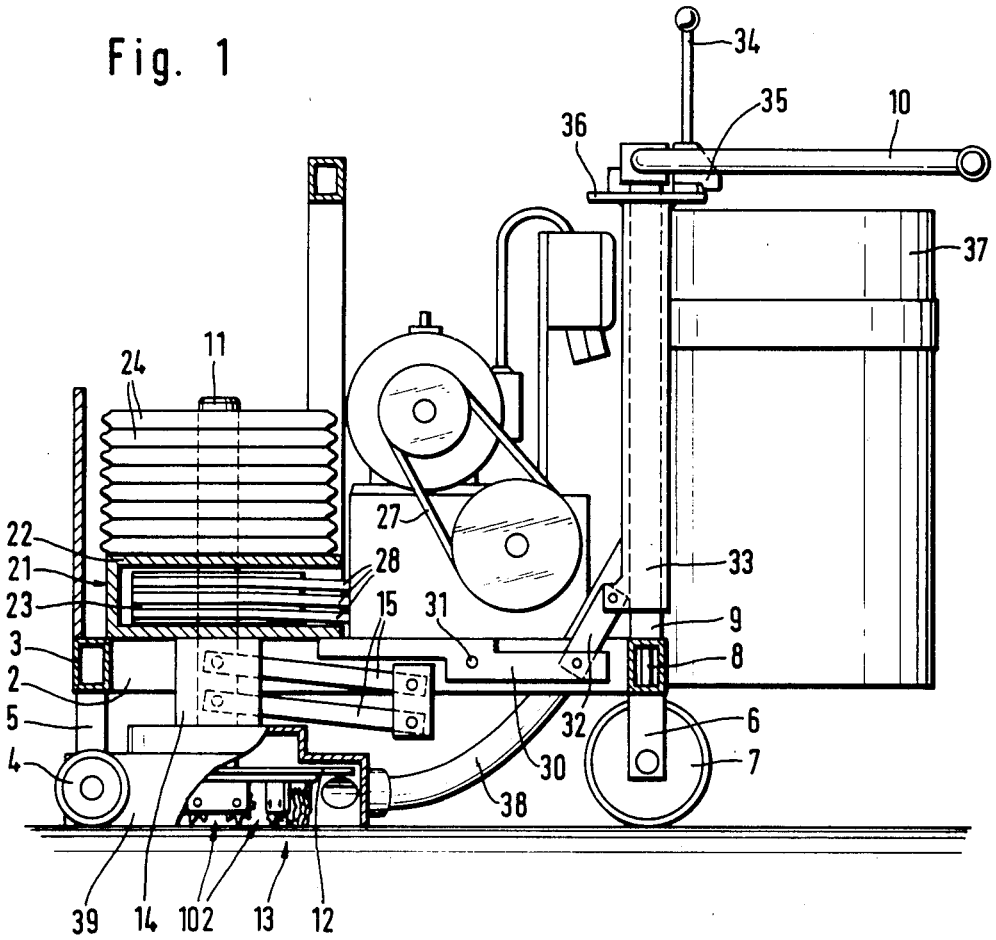
FIG. 1 is a front elevation view of a machine equipped with a rotary tool of the invention.
Figure 2:
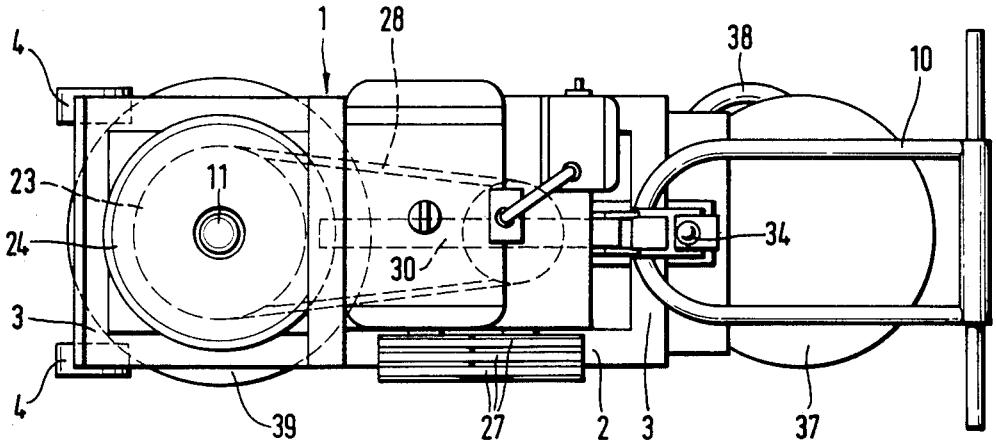
FIG. 2 is a plan view of the machine according to FIG. 1.

FIGS. 1 and 2 show a machine of the kind described above and equipped with a chassis frame 1 on which are provided three wheels 4 and 7. The chassis frame 1 is made up of two longitudinal struts 2 and two transverse struts 3. The forward portion of the frame 1 is carried by two mutually parallel wheels 4 each of which is journalled in a vertical bearing carrier. The bearing carriers 5 are fixedly attached to the forward transverse strut 3 in such a manner that the wheels are not rotatable about a vertical axis. The rearward portion of the frame 1 is supported by a control wheel 7 which is journalled in a pivotal fork 6. The pivotally mounted fork 6 is attached to a vertical control shaft 8 which is rotatably journalled in a control tube 9. The control tube 9 is vertically and fixedly mounted on the rearward transverse strut 3. The machine is controlled by means of a handle 10 which is mounted at the upper end of the control shaft 8 and thereby connected to the steering fork 6.

A vertical tool drive shaft 11 is mounted in the forward portion of the frame between the two longitudinal struts 2 and is perpendicular to the longitudinal axis of the machine. The vertical tool drive shaft 11 is equipped with a tool holder 12 at its lower end which carries a horizontally positioned rotary tool 13 in the form of a cutter head or milling head. The shaft 11 is journalled in a bearing housing 14. The housing 14 is articulately connected via two sets of parallel guide rods 15 to the longitudinal struts 2. By means of this suspension, the bearing housing 14 is freely movable in the vertical direction relative to the frame so that the weight of the housing 14, of the rotary tool 13 and of the weights 24 bears against the base to be worked. The guide rods 15 prevent a horizontal movement of the bearing housing 14 relative to the chassis frame 1.

A weight frame 21 which includes a yoke 22 is mounted at the upper portion of the bearing housing 14. The frame 21 encloses a belt pulley 23 which is secured on the shaft 11. In this way, the rotation of the motor output shaft is transmitted to the shaft 11 via the V-belt drives 27 and 28 which thereby drives the tool holder 12 and the rotary tool 13.

The tool holder 12 can be moved in the vertical direction upwardly or downwardly by means of a lever 30 which is rotatably journalled on a horizontal shaft 31 which is held by longitudinal struts 2. The forward end of the lever is connected with the weight frame 21 which carries the weights 24 and the rearward end of the lever 30 is connected with the vertically moveable positioning tube 33 via a connecting lever 32. The positioning tube 33 encloses the control tube 9 and is displaceable in the vertical direction with respect thereto.

A control lever 34 is hinged to a handle 10 in a horizontal shaft and is in engagement with a horizontal disk 36 via an excenter 35 at its lower end. The disk 36 is connected to the upper end of the tube 33. The rotary tool 13 is lifted and lowered between its working position whereat it bears upon the surface to be worked and a position spaced from this surface by lifting and lowering the control lever 34 which the operator can do with one hand while guiding the machine with the other hand via a handle 10.

If the control lever 34 is pulled to a horizontal position, the excenter 35 presses against the tube 33 and the lever 30 lifts the rotary tool 13 and the loading weights 24 from the surface of the base to be worked. The excenter 35 of the control lever is so configured that when the lever 34 is brought into a vertical position, the excenter 35 is lifted from the disk 36 and the tube 33 is released so as to move freely in the upward direction on the control tube 9 until the rotary tool bears entirely on the base. In this connection, it is noted that the weight of the rotary tool and the supplementary weights 24 push the tube 33 upwardly. The disk 36 on the tube 33 is vertically adjustable in order to compensate for wear on the cutter wheels thereby reducing the play between the disk 36 and the excenter 35 to the necessary minimum so as to permit the rotary tool 13 to lie completely on the base under the total added weight when the lever 34 is placed in the work position.

During the operating procedure, a considerable amount of dust is produced from the material removed from the base. The machine can be provided with a vacuum apparatus in order to direct the dust away and to prevent irritation to the operator of the machine. The vacuum apparatus 37 is mounted on the frame 1 and includes a tube 38 which communicates with a cover 39 which is hinged to the bearing housing 14 and surrounds the rotary tool 13.

It is especially advantageous to attach the rotary tool to the tool holder in such a manner that oscillations are attenuated. This permits a gentle start-up of the working operation whereby the wear on the cutter wheels is reduced. Further, less vibration occurs which makes the work easier and reduces noise as well as wear on the rotary tool. In addition, a better surface of the base being worked is achieved.

Figure 3:
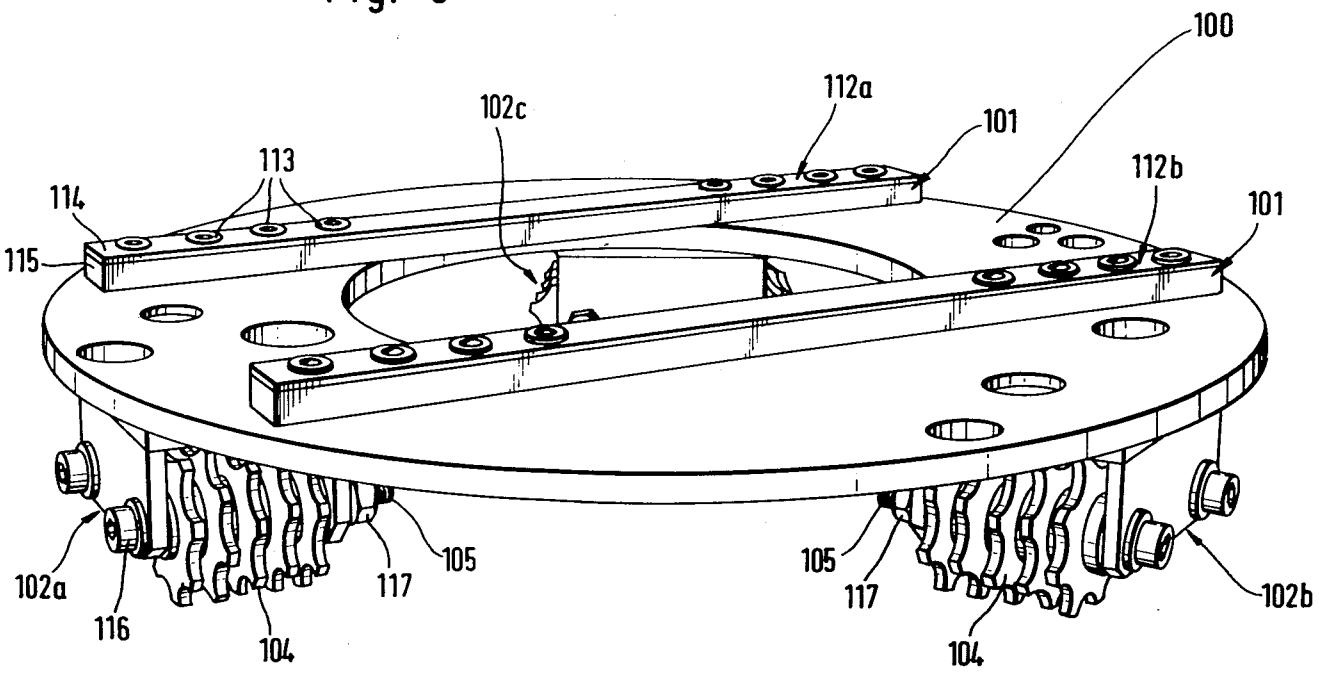
FIG. 3 is a perspective view of the rotary tool according to the invention.

FIG. 3 shows a rotary tool according to the invention and includes a tool plate 100, attachment means 101 and three cutter-wheel units 102*a* to 102*c*. The attachment means includes two mutually parallel bars 112*a*, 112*b* wherein a plurality of winding bushes 113 are inserted. In so far as a vibration attenuating suspension is desired, each attachment unit can comprise a flat iron strip 114 and an attenuating strip 115 disposed therebeneath and made of rubber-like material. The individual cutter-wheel holders 102 include two axles 105 configured as threaded bolts and a plurality of cutter wheels 104.

Figure 4:
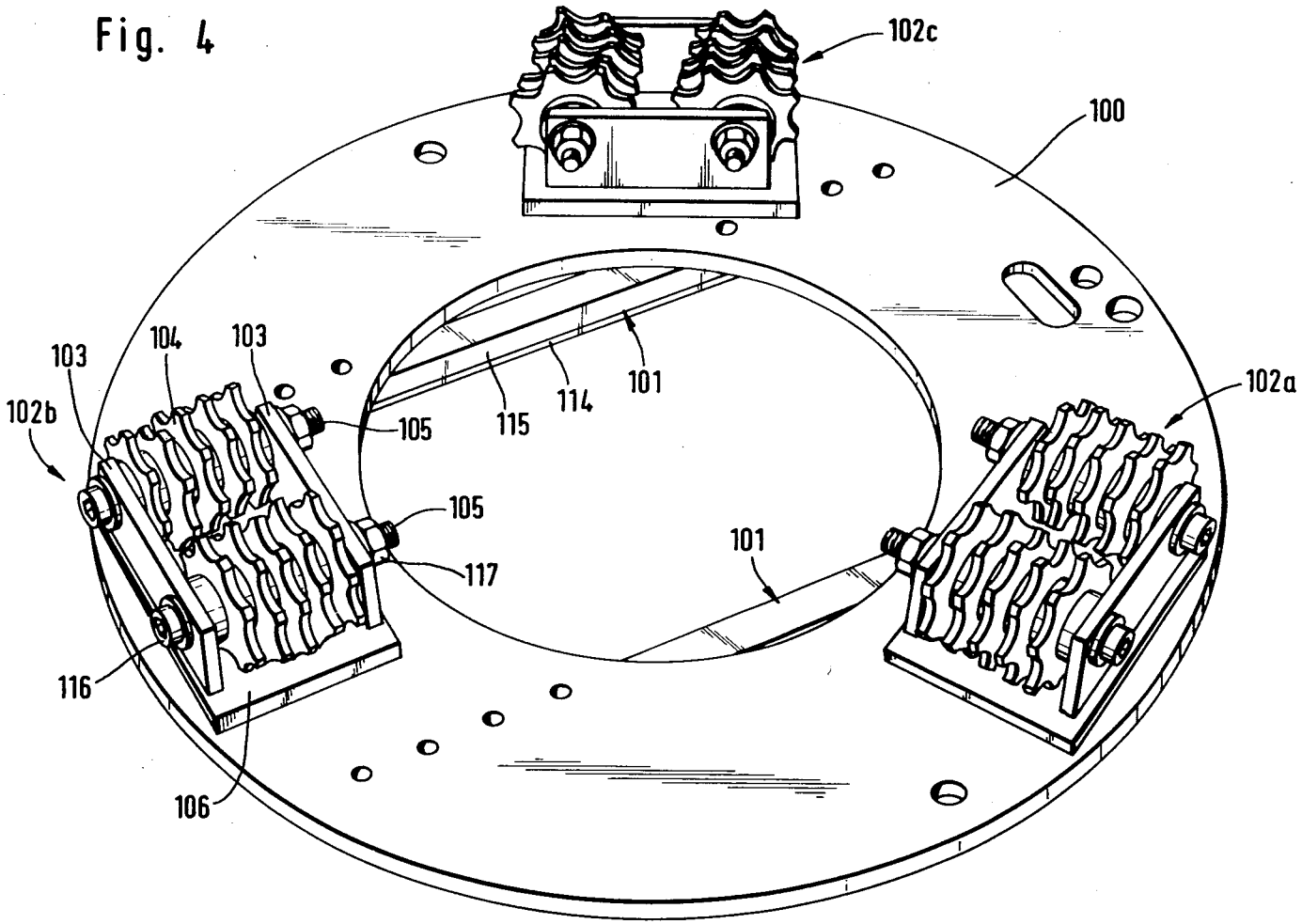
FIG. 4 is a perspective view showing the rotary tool from the bottom.

FIG. 4 is a perspective view of the rotary tool according to the invention wherein the latter has been turned over to show the cutter-wheel holders 102*a* to 102*c* mounted on the tool plate 100. Furthermore, parts of the attachment means 101 are visible through a central opening in the plate. The cutter-wheel holders 102 are U-shaped in cross section and include two legs 103 and a transverse plate 106 which is seated flat against the tool plate 100. The transverse plate 106 can be attached to the plate 100 by means of threaded fasteners or by means of a weld connection. The axles 105 are parallel to each other as are the legs 103 so that the axles 105 are parallel to a radius of the tool plate 100 and straddle the latter. More specifically, the radius passes between the two axles so that each axle is spaced from the radius.

Figure 5:
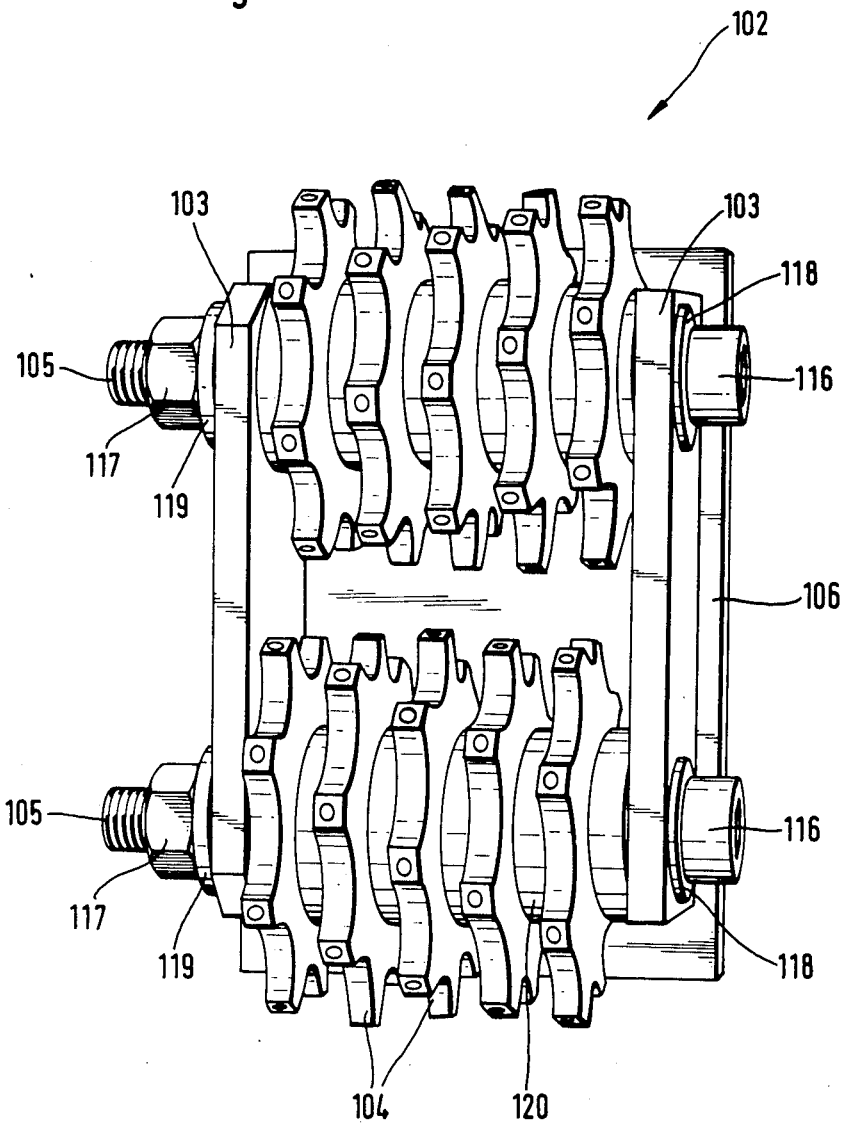
FIG. 5 shows a cutter-wheel unit equipped with a plurality of cutter wheels mounted on two mutually adjacent axles.

FIG. 5 shows an individual cutter-wheel holder 102 equipped with legs 103 and transverse plate 106. The mutually parallel axles 105 are configured as allen screws having smooth shanks (not shown) and the usual nuts 117. Respective washers 118 and 119 are interposed with respect to the legs 103. Bushings 120 are placed over the axles and positioned so as to be between individual cutting wheels 104. The bushings all have the same thickness; however, the bushings disposed between the legs 103 and the next adjacent cutter wheels have different thicknesses so that the cutter wheels 104 of the two axles 105 are axially displaced with respect to each other.

Figure 6A:
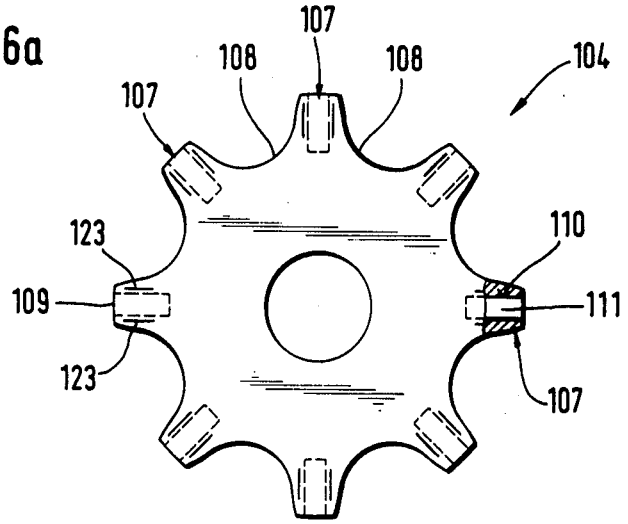
FIG. 6*a* is an elevation view of one of the cutter wheels.
Figure 6B:
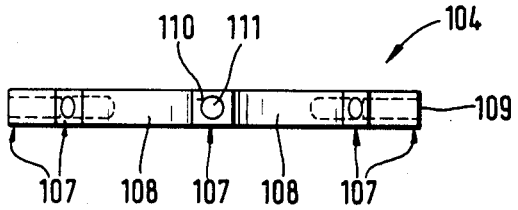
FIG. 6*b* is a top plan view of the cutter wheel of FIG. 6*a*.
Figure 6C:
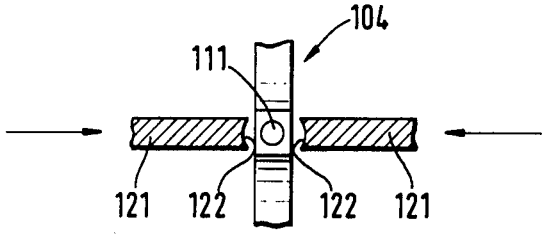
FIG. 6*c* shows how a hard metal insert is fixedly seated in a cutter wheel.

FIG. 6 is a side elevation view of a cutter wheel and shows details thereof. The cutter wheel includes individual projections 107 separated by corresponding recesses 108. The projections have flats 109 and include circular sections as shown in FIG. 6*b*. A bore 110 is provided in the surface of each flat to accommodate a hard metal pin 111. This hard metal pin 111 is clamped into the bore by means of press tools 121 as shown in FIG. 6*c*. Each press tool has a circularly-shaped recess 122. The press tools 121 are applied laterally to the projections 107 in the region of the bore 110.

This action causes indentations 123 to be formed at the projections 107.

The hard metal pin 111 can be inserted into the bore 110 either with a tolerance fit or with a press fit. Cutter wheels equipped with hard metal pins inserted in this manner offer an economical advantage when compared to such pins wherein the latter are soldered into the bore. This is especially of significance since the cutter wheels are parts having a high rate of wear and are a substantial cost factor for operating the machine.

It is understood that the foregoing description is that of the preferred embodiments of the invention and that various changes and modifications may be made thereto without departing from the spirit and scope of the invention as defined in the appended claims.

What is claimed is:

1. A rotary tool for attachment to a machine for working and smoothing an even surface of a base made of cement, concrete or similar hard material, the machine including a multi-wheeled vehicle for moving the rotary tool across the base from a standstill position and at least one tool drive shaft arranged on the vehicle, the tool drive shaft defining a longitudinal axis extending perpendicularly to the base to be worked and having a tool holder for holding the rotary tool for rotation about said axis, the rotary tool comprising:

a tool plate having a circular periphery;

attachment means for mounting said plate to the tool holder in a position perpendicular to said axis for rotation about said axis;

a plurality of cutter-wheel units attached to and distributed on said plate at predetermined locations thereon radially spaced from said longitudinal axis;

each of said cutter-wheel units including a frame attached to said plate, said frame including two mutually parallel bracket-like legs extending downwardly from said tool plate so as to be perpendicular thereto and approximately tangential to said periphery; and, two mutually parallel axles mounted in said legs so as to define respective rotational axes parallel to said plate; and, each of said cutter wheel units further including a plurality of cutter wheels each of which has a plurality of abrading tips for abrading and smoothing the base, said cutter wheels being grouped into two groups mounted on respective ones of said axles so as to rotate freely about said rotational axes as said plate rotates about said longitudinal axis and said cutter wheels abrade and smooth said base; and, said axles being spaced laterally from and being substantially parallel to a radius passing through said longitudinal axis thereby causing said abrading tips to also abrade and smooth the base when said machine is in said standstill position.

2. The rotary tool of claim 1, said plurality of cutter wheels being grouped into two numerically equal groups disposed on respective ones of said axles; and, each of said cutter-wheel units comprising spacer means disposed between the cutter wheels of said groups so as to displace the cutter wheels of one of the groups from the cutter wheels of the other one of the groups.

3. The rotary tool of claim 1, said plurality of cutter-wheel units being three in number evenly distributed with equal angular spacing one next to the other.

4. The rotary tool of claim 1, said frame being a U-shaped structure comprising a base and said bracket-like legs, the latter defining respective right angles with said base, said base being seated flat against said tool plate.

5. The rotary tool of claim 1, said axle means comprising two axles in the form of mutually parallel stationary bolts tensioned between said bracket-like legs.

6. The rotary tool of claim 1, said cutter-wheel units being rotated by the tool drive shaft in a plane parallel to the base, said axle means including two axles disposed in said plane on respective sides of and spaced from said radius passing through said longitudinal axis.

7. The rotary tool of claim 6, said two axles being symmetrically positioned with respect to said radius.

8. The rotary tool of claim 1, each of said cutter wheels being plate-like members having a plurality of point-like projections disposed evenly about the periphery thereof, each two mutually adjacent ones of said projections being separated by a concave recess.

9. The rotary tool of claim 8, each of said projections having a flat formed thereon; said cutter wheel having a plurality of bores formed into the flats of corresponding ones of said projections so as to be on respective radii to the rotational axis of the cutter wheel; and, a plurality of hard metal pins clamped into corresponding ones of said bores.

10. The rotary tool of claim 9, said projections of said cutter wheel being eight in number evenly spaced one from the other about the periphery thereof at an angular spacing of 45°.

* * * * *